US005689966A

United States Patent [19]

Zess et al.

[11] Patent Number: 5,689,966

[45] Date of Patent: Nov. 25, 1997

[54] METHOD AND APPARATUS FOR DESUPERHEATING REFRIGERANT

[75] Inventors: James A. Zess, Kelso; M. Kevin Drost; Charles J. Call, both of Richland, all of Wash.

[73] Assignee: Battelle Memorial Institute, Richland, Wash.

[21] Appl. No.: 620,516

[22] Filed: Mar. 22, 1996

[51] Int. Cl.[6] ..... F25B 27/00; F25D 17/02

[52] U.S. Cl. ..... 62/238.6; 62/99; 62/506

[58] Field of Search ..... 62/98, 99, 238.6, 62/305, 506–507, 513, 430; 165/104.21

[56] References Cited

U.S. PATENT DOCUMENTS

| | | | |
|---|---|---|---|
| 2,663,159 | 12/1953 | Ullstrand | 62/99 |
| 3,131,553 | 5/1964 | Ross | 62/506 |
| 4,373,346 | 2/1983 | Hebert et al. | 62/238.6 |
| 4,446,703 | 5/1984 | Gilbertson | 62/113 |
| 4,502,292 | 3/1985 | Ares et al. | 62/238.6 |
| 4,570,702 | 2/1986 | Stafford et al. | 165/159 |
| 4,751,823 | 6/1988 | Hans | 62/201 |
| 4,796,437 | 1/1989 | James | 62/79 |
| 5,297,397 | 3/1994 | Pointer | 62/238.6 |
| 5,453,641 | 9/1995 | Mundlinger et al. | 165/104.33 |

*Primary Examiner*—William Doerrler
*Attorney, Agent, or Firm*—Paul W. Zimmerman

[57] ABSTRACT

The present invention is an apparatus and method for de-superheating a primary refrigerant leaving a compressor wherein a secondary refrigerant is used between the primary refrigerant to be de-superheated. Reject heat is advantageously used for heat reclaim.

15 Claims, 5 Drawing Sheets

*TYPICAL WATER COOLED CONDENSER REFRIGERATION SYSTEM PLUS EVAPORATIVE MICRO-CHANNEL HEAT EXCHANGER*

TYPICAL WATER COOLED CONDENSER REFRIGERATION SYSTEM
PLUS
EVAPORATIVE MICRO-CHANNEL HEAT EXCHANGER

METHOD AND APPARATUS FOR DESUPERHEATING REFRIGERANT

This invention was made with Government support under Contract DE-AC06-76RLO 1830 awarded by the U.S. Department of Energy. The Government has certain rights in the invention.

FIELD OF THE INVENTION

This invention relates to refrigerant de-superheating, particularly for cooling systems rejecting heat from refrigerant to cooling water. More specifically, the invention relates to an intermediate refrigerant loop for de-superheating primary refrigerant prior to condensing the primary refrigerant.

BACKGROUND OF THE INVENTION

In a refrigeration or cooling cycle (FIG. 1), a heat load $Q_L$ is received by an evaporator 100 that evaporates a primary refrigerant 101 into the superheated region at a first pressure. Superheating is done to prevent liquid phase droplets from entering the compressor 102. The compressor 102 raises the pressure of the superheated primary refrigerant thereby further superheating the primary refrigerant. From the compressor 102, the superheated primary refrigerant 101 is passed to a condenser 104 where the heat load is rejected as $Q_H$. The condensed primary refrigerant passes through a throttling valve 106 back to the evaporator 100.

Although superheating the primary refrigerant 101 permits improved compressor operation, it causes lower condenser performance. Superheating is further exacerbated by the compressor 102. Within the condenser 104, the superheated refrigerant is first de-superheated then condensed. It has long been recognized that the condenser 104 would be more effective if its entire area was used for condensing instead of using some of its area for sensible heat removal during de-superheating. Further, in condensers using water to remove heat from the refrigerant, the superheated refrigerant heats a boundary layer of the water above a calcium carbonate precipitation temperature thereby causing calcium carbonate deposits in the tubes of the water side and diminishing heat transfer performance.

In addition to calcium carbonate, other minerals including calcium, magnesium and iron accumulate in cooling water that is evaporatively cooled thereby increasing concentration of these minerals. If the cooling water boundary layer is kept below about 110° F., the minerals would stay in solution under most cooling tower operating conditions. However, superheated primary refrigerant entering the condenser at about 155° F. or higher raises the water boundary layer temperature well above 110° F. and causing precipitation of minerals on the water side of the condenser.

Previous efforts to de-superheat the refrigerant have focused on heat reclaim. Heat reclaim typically involves routing the superheated refrigerant to a heat exchanger placed in an incoming stream of air or water which de-superheats the refrigerant and transfers heat to the incoming stream. However, because of the poor heat transfer from superheated refrigerant (gas phase) through the heat exchanger to the incoming stream, the area of the heat exchanger must be large. The large size of the heat exchanger results in higher cost and increased pressure drop of the refrigerant and either requires additional compressor capacity to overcome the added pressure drop, or reduced cooling effect. Hence, many heat reclaim installations actually experience a net energy consumption increase instead of the expected savings.

Thus, there is still a need for a refrigerant de-superheater that can consistently achieve a net energy savings for refrigerant based cooling systems.

SUMMARY OF THE INVENTION

The present invention is an apparatus and method for de-superheating a primary refrigerant leaving a compressor wherein a secondary refrigerant is used between the primary refrigerant to be de-superheated.

It is an object of the present invention to de-superheat a refrigerant before it enters a condenser.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

Figure 1:
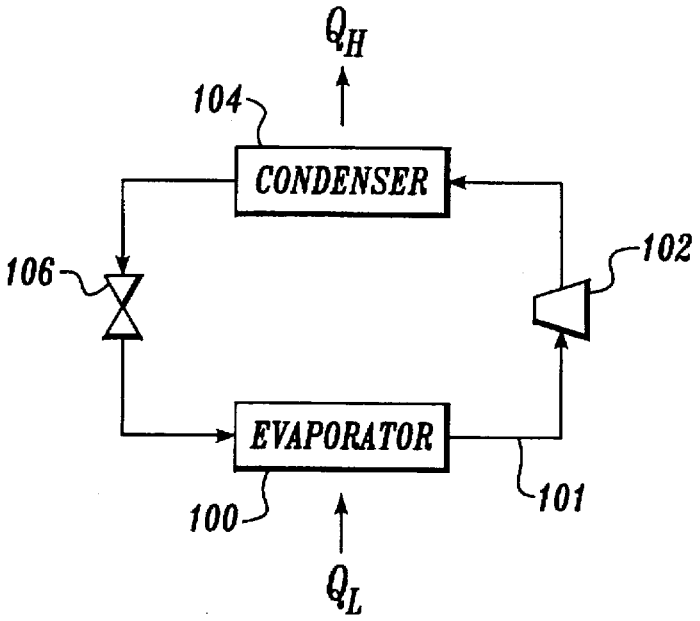
Fig. 1 (PRIOR ART)
FIG. 1 is a simple schematic of a prior art cooling system.
Figure 2:
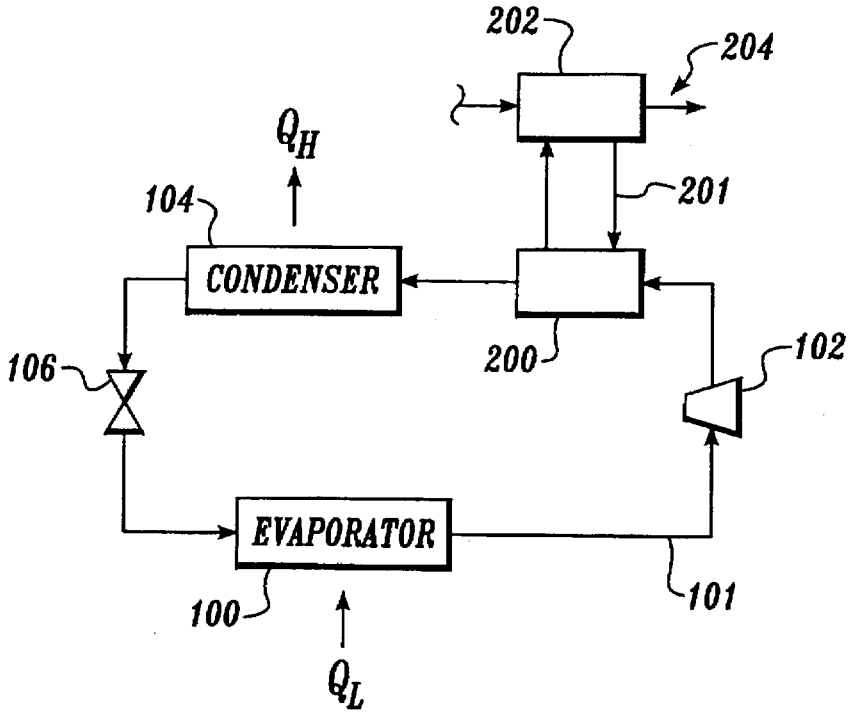
FIG. 2 is a simple schematic of the de-superheater of the present invention in a cooling system.

The apparatus of the present invention shown in FIG. 2 is for de-superheating a primary refrigerant exiting a compressor 102. The apparatus of the present invention has a first heat exchanger 200 placed between the compressor 102 and a condenser 104. The first heat exchanger 200 has a primary side for receiving the superheated primary refrigerant 101, and a secondary side for receiving an intermediate refrigerant 201 in a liquid state, wherein the superheated primary refrigerant 101 is de-superheated while the intermediate refrigerant 201 is evaporated. Further, a second heat exchanger 202 is connected to the first heat exchanger 200, for receiving the evaporated intermediate refrigerant 201 and exchanging heat to a heat sink fluid 204 thereby condensing the evaporated intermediate refrigerant 201.

Figure 2A:
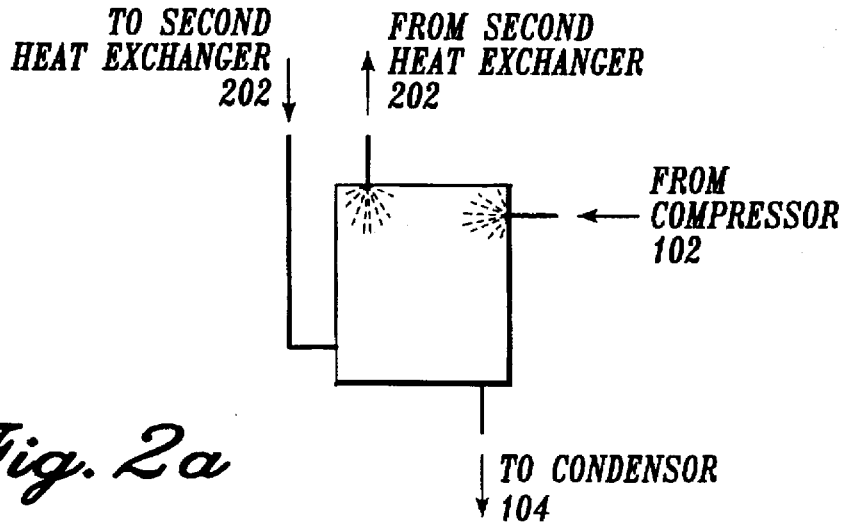
FIG. 2*a* is a cross section of a direct contact heat exchanger.

According to the present invention, the primary refrigerant 101 may be any refrigerant, but is commonly a freon based refrigerant, for example R22 or its non-CFC (Chlorinated FluoroCarbon) equivalent. The intermediate refrigerant 201 may be any refrigerant that will evaporate at the temperature of condensation of the primary refrigerant 101 and is preferably a freon based refrigerant, for example R113 or its non-CFC equivalent. Considerations of selection of an intermediate refrigerant 201 include (I) optimizing pressure differentials between refrigerants and between the refrigerants and environmental pressure that may include minimizing pressure differential between the primary refrigerant 101 and the intermediate refrigerant 201, (ii) chemical compatibility between the primary and intermediate refrigerants 101, 201, and (iii) and cost. In a non-direct contact heat exchanger, the mechanical strength requirements of the wall(s) separating refrigerants within the first heat exchanger 200 are advantageously minimized when the vapor pressure of the intermediate refrigerant 201 is substantially matched to the pressure of the primary refrigerant 101. Further advantages are realized when the intermediate refrigerant 201 is the same as the primary refrigerant 101. Specifically, when the refrigerants 101, 201 are the same, chemical compatibility is maximized and leaks may be tolerated up to and including direct contact heat exchange. When the first heat exchanger 200 is a direct contact heat exchanger (FIG. 2*a*), the second heat exchanger 202 is a side stream heat exchanger.

Figure 2B:
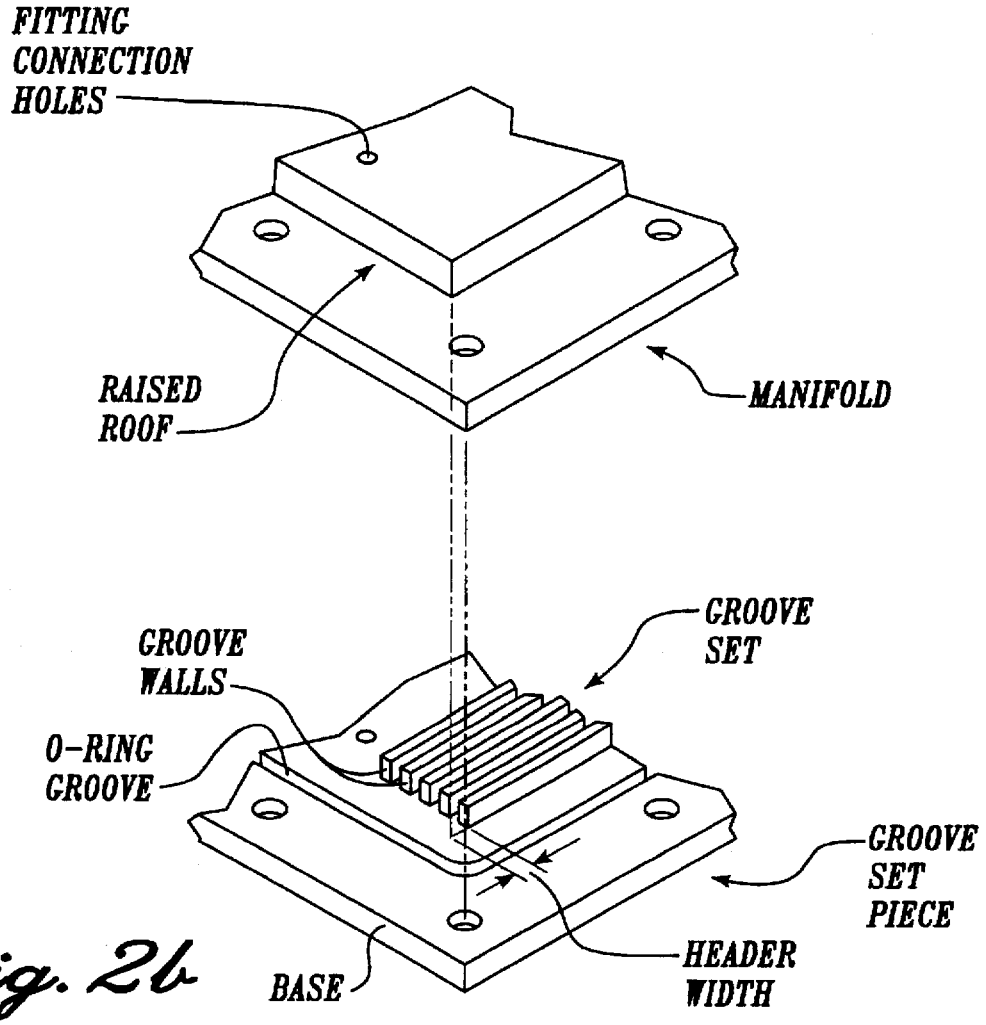
FIG. 2*b* is an isometric view of a microchannel heat exchanger.

According to the present invention, it is of utmost importance that the first heat exchanger 200 have as low a pressure drop as possible with high heat transfer. It is preferred that the pressure drop not exceed about 3 psi to maintain a net energy savings. Additionally, for retrofitting, it is important that the heat exchanger(s) 200, 202 be as compact as possible. Accordingly, it is preferred that the first heat exchanger 200 be constructed with microchannels (FIG. 2*b*). Microchannels have a hydraulic radius from about 10 microns to about 500 microns.

As an example, a first heat exchanger 100 for a 100 ton system, may have about 9 or 10 laminates or layers having thousands of microchannels arranged so that the primary refrigerant 101 is in cross flow with the intermediate refrigerant 201. Overall dimensions of the first heat exchanger are about 18 inches in width in the direction of flow of the primary refrigerant 101, 30 inches in length in the direction of flow of the intermediate refrigerant 201, and about 3.5 inches deep for the accumulative thicknesses of the laminates. This first heat exchanger 200 de-superheats the primary refrigerant 101 by about 50° F. with a pressure drop of about 0.6 psi. Thus, it is possible to provide de-superheating of the primary refrigerant with a pressure drop less than about 1 psi.

Figure 3:
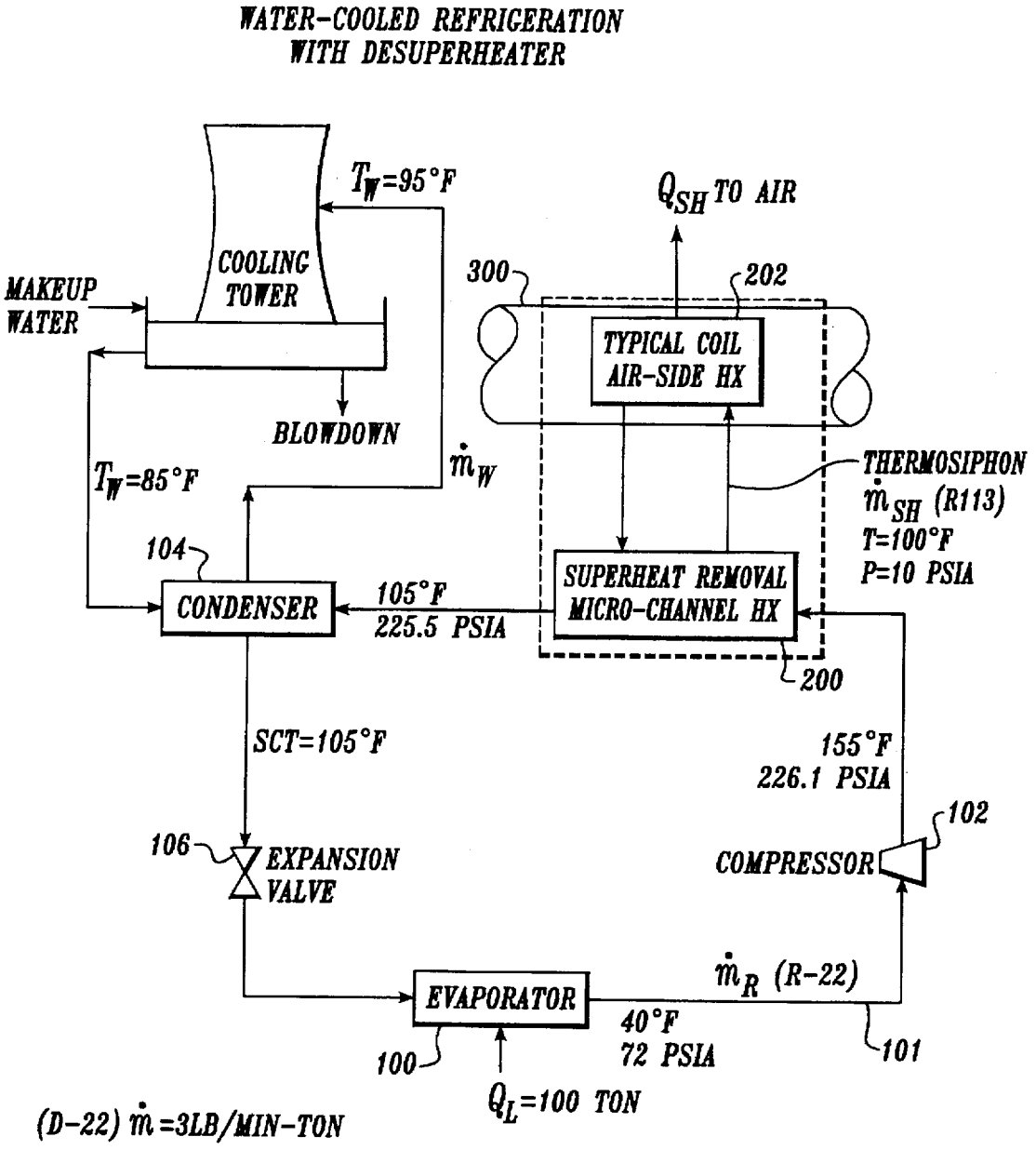
FIG. 3 is an expanded schematic showing the de-superheater rejecting heat to air.
Figure 4:
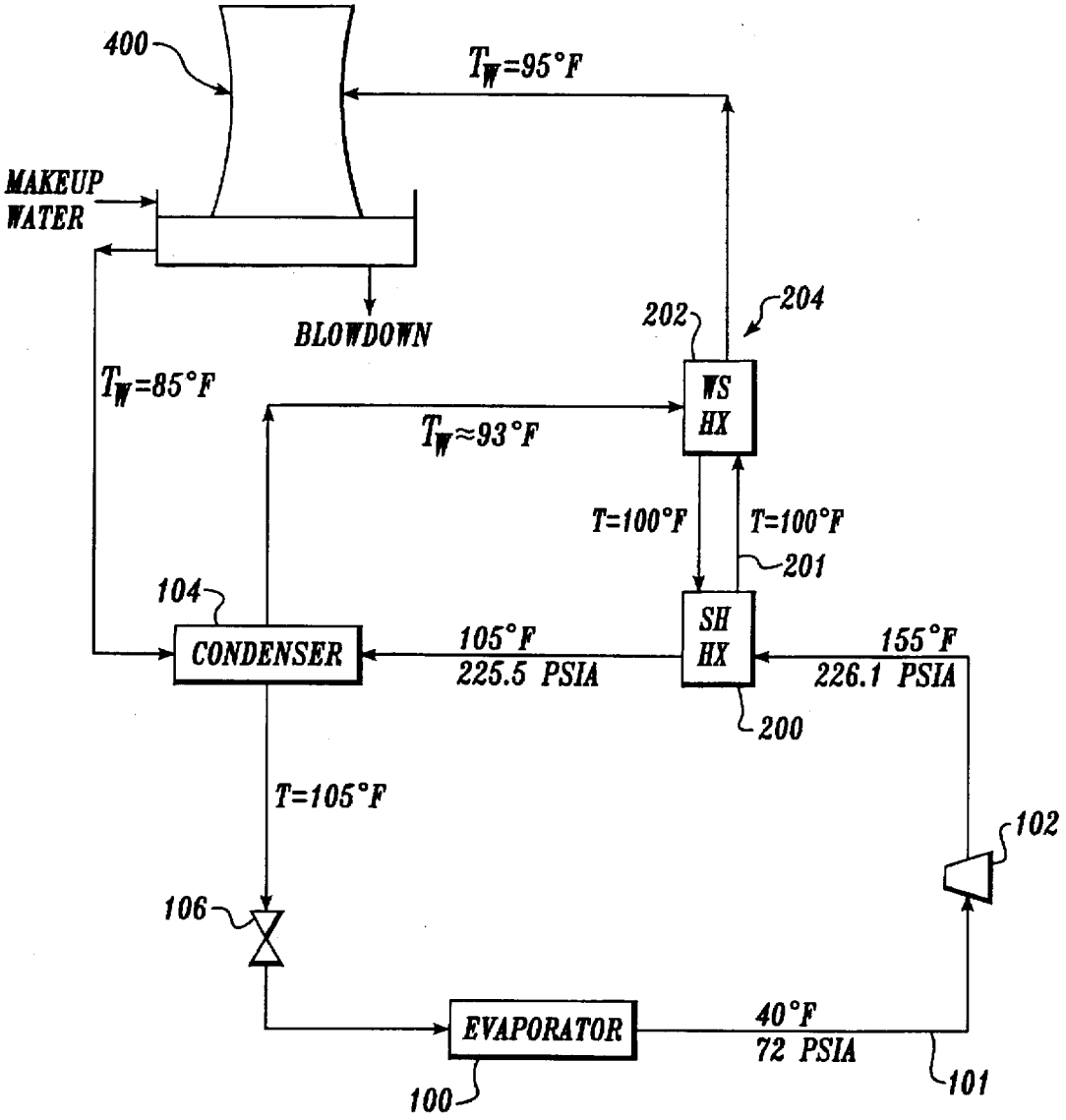
FIG. 4 is an expanded schematic showing the de-superheater rejecting heat to water.

The second heat exchanger 202 may reject heat to an external environment, for example atmospheric air, or to a water source. Alternatively, the second heat exchanger 202 may reject heat to preheat a stream, for example, air, water or other process stream. When rejecting heat to air (FIG. 3) a coil condenser may be used. A duct 300 is shown illustrating heat reclaim. When rejecting heat to water, a water cooled condenser (FIG. 4) may be used. Because the pressure drop for flow of the intermediate refrigerant 201 is also small, it is preferred to avoid the use of a pump and rely on a pressure differential between the first and second heat exchangers 200, 202 to provide a thermosyphon effect to move the intermediate refrigerant 201. However, in certain applications where the thermosyphon effect is insufficient, the use of a small pump for moving the intermediate refrigerant 201 may be desirable. In cooling systems wherein heat is removed from the condenser 104 with water, the heated water from the condenser 104 may be used to further remove heat from the second heat exchanger 202 as shown in FIG. 4. The primary refrigerant 101 normally condenses at a temperature of about 10° F. higher than the exiting water temperature. The cooling tower 400 cools the water to within about 7° F. of the outside wet bulb temperature. For condenser water exiting at about 95° F., the primary refrigerant 101 condenses at about 105° F. at a pressure of about 210 psig and a flow rate of about 3 lb/min-ton or 0.7 $ft^3$/min-ton of saturated vapor. Thus, for primary refrigerant at about 155° F., any amount of de-superheating up to about 50° F. of de-superheating is desired.

According to the present invention, a method for de-superheating a primary refrigerant exiting a compressor, has the steps of (a) placing a first heat exchanger between the compressor and a condenser, and (b) flowing an intermediate refrigerant through the first heat exchanger to de-superheat a primary refrigerant. The first heat exchanger has a primary side for receiving the superheated primary refrigerant, and a secondary side for receiving the intermediate refrigerant in a liquid state, therein de-superheating the superheated refrigerant and evaporating the intermediate refrigerant. A second heat exchanger connected to the first heat exchanger exchanges heat to a heat sink fluid and condenses the evaporated intermediate refrigerant.

By de-superheating the primary refrigerant, scale formation in the water side of the condenser 104 is eliminated or substantially reduced without the use of chemicals. Further, electrical energy is reduced through improved heat transfer.

Figure 5:
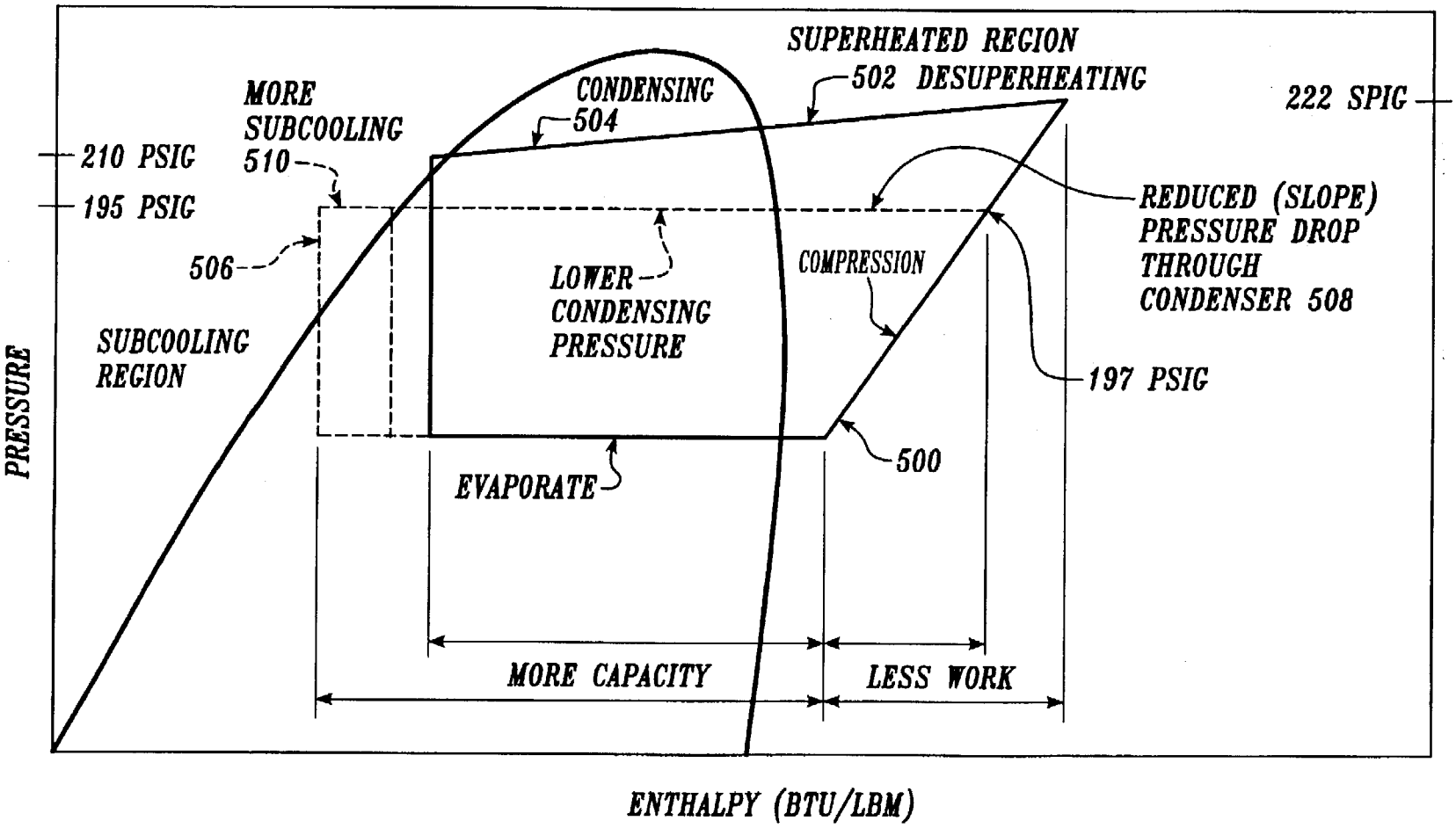
FIG. 5 is a pressure-enthalpy diagram showing the improved performance of a cooling system with a de-superheater according to the present invention compared to a prior art cooling system without the de-superheater.

In operation, when a portion of a condenser must operate as a de-superheater, there is greater pressure drop and less heat transfer than if all of the condenser operates as a condenser. The advantage of using a de-superheater as described above is shown in the pressure-enthalpy diagram of FIG. 5. The solid line trapezoid 500 represents the thermodynamic operating parameters of a cooling system wherein de-superheating 502 is accomplished in the condenser 104 followed by condensing 504. The broken lines 506 represent the thermodynamic operating parameters after insertion of the first heat exchanger 200. The low pressure drop through the first heat exchanger 200, together with removing the de-superheat function from the condenser 104, permit operation at lower pressure 508. Assuming a retrofit, the condenser 104 has the same surface area as before that is now completely available for condensing permitting greater subcooling 510. Additional performance advantages are realized over time by avoidance of scale on the water side of the condenser 104.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. An apparatus for de-superheating a primary refrigerant exiting a compressor, the apparatus comprising:

(a) a first heat exchanger placed between the compressor and a condenser, said first heat exchanger having a primary side for receiving the superheated primary refrigerant, and a secondary side for receiving an intermediate refrigerant in a liquid state, wherein said superheated primary refrigerant is de-superheated while said intermediate refrigerant is evaporated, wherein a pressure of said intermediate refrigerant is substantially matched to a pressure of said primary refrigerant; and (b) a second heat exchanger connected to the first heat exchanger, for receiving said evaporated intermediate refrigerant and exchange heat to a heat sink fluid thereby condensing the evaporated intermediate refrigerant.

2. The apparatus as recited in claim 1, wherein said first heat exchanger is a microchannel heat exchanger.

3. The apparatus as recited in claim 1, wherein said first heat exchanger is a direct contact heat exchanger.

4. The apparatus as recited in claim 1, wherein said heat sink fluid is air.

5. The apparatus as recited in claim 1, wherein said heat sink fluid is water.

6. The apparatus as recited in claim 5, wherein said water is from the condenser.

7. The apparatus as recited in claim 1, wherein said intermediate refrigerant flows by thermosyphoning.

8. The apparatus as recited in claim 1, wherein said primary refrigerant and said intermediate refrigerant are the same.

9. A method for de-superheating a primary refrigerant exiting a compressor, comprising the steps of:

(a) placing a first heat exchanger between the compressor and a condenser, said first heat exchanger having a primary side for receiving the superheated primary refrigerant, and a secondary side for receiving an intermediate refrigerant in a liquid state, therein de-superheating said superheated refrigerant and evaporating said intermediate refrigerant, wherein a pressure of said intermediate refrigerant is substantially matched to a pressure of said primary refrigerant; and (b) flowing the evaporated intermediate refrigerant to a second heat exchanger connected to the first heat exchanger, and exchanging heat to a heat sink fluid and condensing the evaporated intermediate refrigerant.

10. The method as recited in claim 9, wherein said first heat exchanger is a microchannel heat exchanger.

11. The method as recited in claim 9, wherein said first heat exchanger is a direct contact heat exchanger.

12. The method as recited in claim 9, wherein said heat sink fluid is air.

13. The method as recited in claim 9, wherein said heat sink fluid is water.

14. The method as recited in claim 13, wherein said water is from the condenser.

15. The method as recited in claim 9, wherein said intermediate refrigerant flows by thermosyphoning.

* * * * *

UNITED STATES PATENT AND TRADEMARK OFFICE

CERTIFICATE OF CORRECTION

PATENT NO. : 5,689,966
DATED : November 25, 1997
INVENTOR(S) : Zess, et. al.

It is certified that error appears in the above-identified patent and that said Letters Patent is hereby corrected as shown below:

Title page, item [73], Assignee: should read --Battelle Memorial Institute, Richland, Wash. a part interest with James A. Zess a part interest.

Signed and Sealed this

Second Day of June, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,689,966
DATED : 11/25/97
INVENTOR(S) : James A. Zess, M. Kevin Drost, Charles J. Call.

It is certified that error appears in the above-identified patent and that said Letters Patent is hereby corrected as shown below:

In column 2, line 40, please change "BRIEF DESCRIPTION OF THE DRAWINGS" to --DESCRIPTION OF THE PREFERRED EMBODIENT(S)--.

Signed and Sealed this

Second Day of February, 1999

*Attest:*

*Attesting Officer*

*Acting Commissioner of Patents and Trademarks*